United States Patent [19]

Kojima et al.

[11] 4,052,573

[45] Oct. 4, 1977

[54] ROTARY OR SLIDE TYPE SWITCH ASSEMBLY HAVING RECESSED PRINTED CIRCUIT SUBSTRATE, INTERPOSED RESILIENT BRIDGING CONTACT AND MOVABLE PRINTED CIRCUIT DISC

[75] Inventors: Tatsuo Kojima, Kyoto; Yoshio Kawai, Kawasaki, both of Japan

[73] Assignee: Murata Manufacturing Co., Ltd., Kyoto, Japan

[21] Appl. No.: 657,059

[22] Filed: Feb. 11, 1976

[30] Foreign Application Priority Data

| | | |
|---|---|---|
| Feb. 17, 1975 | Japan | 50-20024 |
| Nov. 28, 1975 | Japan | 50-161921[U] |
| Nov. 28, 1975 | Japan | 50-161922[U] |
| Nov. 28, 1975 | Japan | 50-161923[U] |

[51] Int. Cl.[2] ..... H01H 19/08; H01H 15/04; H01H 9/00

[52] U.S. Cl. ..... 200/11 DA; 200/11 A; 200/11 K; 200/16 D; 200/276; 200/292

[58] Field of Search ..... 200/11 R, 11 A, 11 D, 200/11 DA, 11 K, 16 R, 16 D, 276, 277, 292

[56] References Cited

U.S. PATENT DOCUMENTS

| | | | |
|---|---|---|---|
| 3,213,212 | 10/1965 | Sefton | 200/11 A X |
| 3,350,530 | 10/1967 | Fry | 200/292 |
| 3,356,817 | 12/1967 | Matthews | 200/292 X |
| 3,558,834 | 1/1971 | Zielke | 200/292 X |
| 3,818,153 | 6/1974 | Aruai | 200/DIG. 29 |
| 3,823,292 | 7/1974 | Murata | 200/276 X |

FOREIGN PATENT DOCUMENTS

| | | | |
|---|---|---|---|
| 860,509 | 12/1952 | Germany | 200/292 |

*Primary Examiner*—James R. Scott
*Attorney, Agent, or Firm*—Birch, Stewart, Kolasch & Birch

[57] ABSTRACT

An electric switch assembly having at least one movable contact element and a plurality of fixed contact elements. The movable contact element can electrically connect at least one of the fixed contact elements to any one of the remaining fixed contacts. The electric switch assembly herein disclosed utilizes intermediate contact pieces each adapted to connect one of the fixed contact elements to the movable contact element therethrough and also to connect the movable contact element to any one of the fixed contact element.

9 Claims, 23 Drawing Figures

ROTARY OR SLIDE TYPE SWITCH ASSEMBLY HAVING RECESSED PRINTED CIRCUIT SUBSTRATE, INTERPOSED RESILIENT BRIDGING CONTACT AND MOVABLE PRINTED CIRCUIT DISC

BACKGROUND OF THE INVENTION

The present invention relates to an electric switch assembly and, more particularly, to an electric switch assembly of a type comprising at least one movable contact element and a plurality of fixed contacts. The movable contact element can electrically connect at least one of the fixed contacts to any one of the remaining fixed contacts.

The electric switch assembly to which the present invention pertains is, most suited for use as a channel selector in audio and/or visual signal handling instruments such as video information recording and/or reproducing devices, radio receivers, television sets, record players and so on but need not be exclusively used for those purposes.

A type of electric switch assembly referred to above is in fact known in the prior art commercially is available. The known electric switch assembly of the type referred to above comprises a substrate of electrically insulating material having a plurality of fixed contacts, which are rigidly mounted on at least one surface of said substrate, and a movable contact element rigidly mounted on a disc of electrically insulating material. The disc is mounted on a manually rotatable shaft for rotation together therewith so that, during rotation of the disc, the movable contact element moves in a substantially circular path. Therefore, the fixed contacts are arranged in a circular configuration on alignment with the circular path of movement of the movable contact element while the movable contact element is so sized as to bridge between two or more of the fixed contacts.

In this prior art electric switch assembly, the fixed contacts are electrically connected to respective terminal members, rigidly secured to an outer peripheral edge of the substrate, by means of printed circuits imprinted on one surface of said substrate. Rigid mounting of the fixed contacts on the surface of the substrate is carried out by the use of metallic eyelets or similar fastening members, equal in number to the number of the fixed contacts. These eyelets or similar fastening members are staked to electrically and physically connect the fixed contacts to the printed circuits on the substrate. The movable contact element is also rigidly mounted on the rotary disc in a substantially similar manner to the mounting of the fixed contacts on the substrate. Even the terminal members, which are separate from the fixed contacts, but electrically connected thereto through the printed circuits, are rigidly mounted on the substrate in a complicated manner comparable to the mounting of any of the fixed contacts and the movable contact element.

Moreover, portions of the fixed contacts which are selectively engaged with the movable contact element are each shaped such that electrical connection between the movable contact element and any one of the fixed contacts is achieved by inserting said movable contact element in between the surface of the substrate and that portion of the fixed contact during rotation of the disc carrying said movable contact element. Unless that portion of each of the fixed contacts is adequately shaped, insertion of the movable contact element between the substrate and that portion of any one of the fixed contacts during rotation of the disc will be hampered because the movable contact element tends to abut against a lateral side edge of that portion of the fixed contact which is elastically biased towards the substrate.

The prior art electric switch assembly of the construction described above requires a complicated manufacturing procedure. This is a result of the complicated shape required for that portion of any one of the fixed contacts and partly because of the employment of the eyelets or similar fastening members necessary to secure the fixed contacts to the substrate and also secure the movable contact element to the rotary disc. Thus, the complicated manufacturing procedures naturally results in an increase in the manufacturing and labor cost.

In addition, unless a protective casing is employed for the switch assembly, each contact point between the movable contact element and the fixed contacts is bared to ambient conditions and is, therefore, susceptible to ambient dust which is likely to result in a failure to complete an electric circuit.

Moreover, by the reason as described above, the number of switching positions available in the prior art switch assembly is fixed and, therefore, a user of the switch assembly cannot readily modify it to correspond to a proposed design of a circuit arrangement.

BRIEF SUMMARY OF THE INVENTION

Accordingly, an essential object of the present invention is to provide an improved electric switch assembly of the type referred to above, wherein no eyelet or similar fastening member is employed thereby substantially eliminating the disadvantages and inconveniences inherent in the prior art switch assemblies.

Another important object of the present invention is to provide an improved electric switch assembly of the type referred to above, which can readily be manufactured without substantially incurring the increased manufacturing and labor costs.

A further object of the present invention is to provide an improved electric switch assembly of the type referred to above, wherein the number of switching positions available can be changed according to the user's desire merely by removing one or more intermediate contact pieces employed to selectively connect the movable contact element to the fixed contacts.

According to the present invention, these and other objects can be accomplished by providing an improved switch assembly of the type referred to above wherein at least one movable contact element is electrically connected to fixed contacts through intermediate contact pieces made of electrically conductive material having a sufficient elasticity. Depending upon the design of the circuitry in which the switch assembly is to be inserted, the number of switching channels achieved by positioning the movable contact element relative to the fixed contacts can be changed as desired merely by removing unnecessary intermetiate contact pieces.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects and features of the present invention will become apparent from the following description taken in conjunction with preferred embodiments thereof with reference to the accompanying drawings, in which.

DETAILED DESCRIPTION OF THE INVENTION

Figure 1:
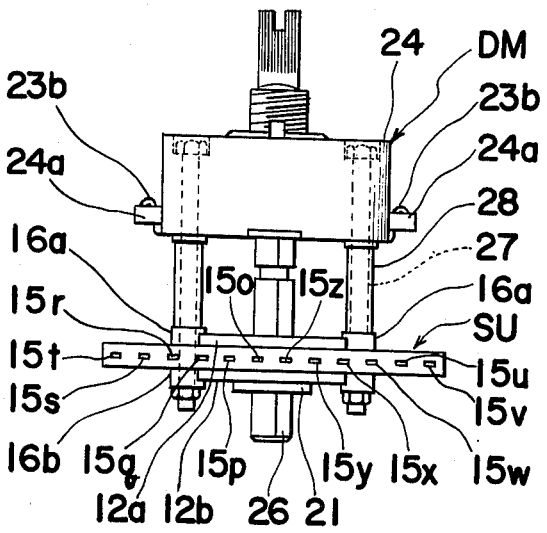
FIG. 1 is a front elevational view of an electric switch assembly according to one embodiment of the present invention.
Figure 4:
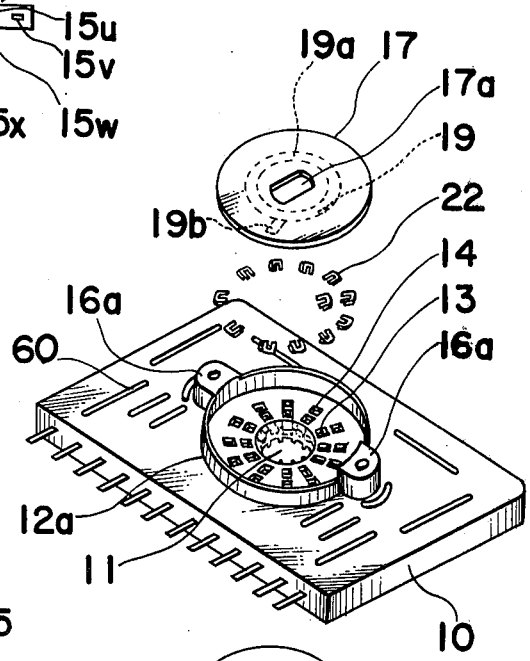
FIG. 4(a) is an exploded view of the switch unit of FIG. 3.
FIG. 4(b) is a top plan view of fixed contact elements as manufactured from a metallic plate member.
Figure 4:
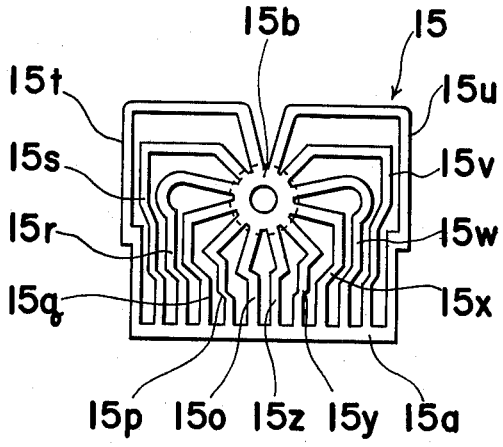
Figure 4:
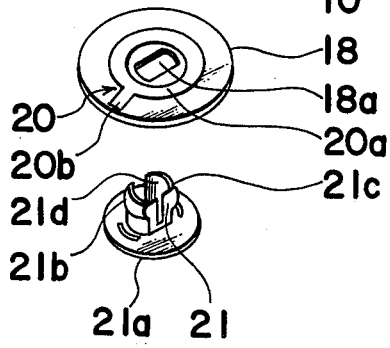

Before the description of the present invention proceeds, it is to be noted that like parts are designated by like reference numerals throughout the accompanying drawings.

Referring to FIGS. 1 to 5 and 17, the electric switch assembly shown may be referred to as a rotary switch assembly and generally comprises a switch unit SU and a detent mechanism DM.

Figure 3:
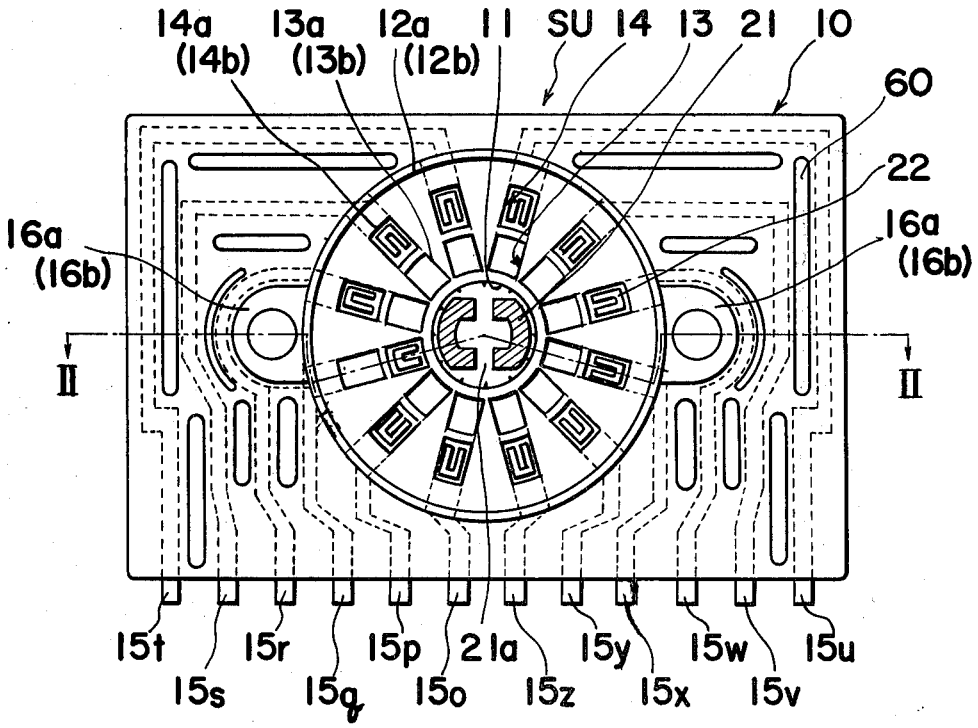
FIG. 3 is a top plan view of a switch unit of the switch assembly of FIG. 1, which switch unit is shown on an enlarged scale.

The switch unit SU comprises a substrate 10 of, for example, rectangular shape as best shown in FIG. 3, which substrate 10 is made of an electrically insulating, plastic material. This substrate has a hole 11, formed therein and extending completely through the thickness of said substrate 10, and is formed with an annular flange **12*a* and 12*b* on each of the opposed surfaces thereof. The annular flanges 12*a* and 12*b* are coaxial with each other and also with the hole 11. In addition to the hole 11, the substrate 10 is also formed therein with a plurality of, for example, two, circular rows of perforations each extending completely through the thickness of the substrate 10 from a portion of one of the opposed surfaces of the substrate 10, which is around the hole 11 and inside the annular flange 12*a*, to that portion of the other of the opposed surfaces of the substrate 10 which is around the hole 11 and inside the annular flange 12*b*. The perforations of one row, that is, an inner row, and the perforations of the other row, that is, an outer row, are generally indicated by 13 and 14, respectively. These perforations 13 and 14 of the inner and outer rows are so arranged that the imaginary circle depicted by each of the inner and outer rows of the perforations 14 and 14 is in coaxial relation with the hole 11 and also with the annular flanges 12*a* and 12*b*. The perforations 13 or 14 of each roware equally spaced from each other in a direction of the circumference of such an imaginary circle. Also the perforations 13 and 14** of the inner and outer rows are respectively radially aligned with each other.

As best shown in FIG. 4(b), fixed contact elements, designated by **15*o*, 15*p*, 15*q*, 15*r*, 15*s*, 15*t*, 15*u*, 15*v*, 15*w*, 15*x*, 15*y* and 15*z*, are designed to be embedded in the substrate 10. However, prior to the fixed contact elements 15*o* to 15*z* being embedded in the substrate 10, they are manufactured from a single plate of metallic material in any known method, for example, by means of stamping or blanking technique. However, it is to be noted that the fixed contact elements 15*o* to 15*z* as manufactured from the metallic plate are connected to each other by a strip 15*a*, connecting the outer ends of the contact elements 15*o* to 15*z* to each other and extending at right angles to said outer ends of said contact elements, and a ring 15*b* connecting the inner ends of the fixed contact elements 15*o* to 15*z* to each other and having an outer diameter smaller than the diameter of the hole 11. After the contact elements 15*o* to 15*z* have been embedded in position in the substrate 10 in a manner as will be described later, the strip 15*a* and the ring 15*b* are removed by cutting to provide the independent and separate fixed contact elements 15*o* to 15*z***.

It is to be noted that the number of the fixed contact elements **15*o* to 15*z* is equal to the number of the perforations 13 or 14 of each row while portions adjacent the respective inner ends of the contact elements 15*o* to 15*z* are radially inwardly arranged towards the ring 15*b*. It is further to be noted that although the portions adjacent the respective outer ends of the fixed contact elements are shown as arranged in a side-by-side relation to each other to form terminals for electrical connection with external wirings, which are ultimately constituted by said portions of said fixed contact elements adjacent said outer ends they may be exposed to the outside from any one of the four sides of the substrate 10, and are not necessarily limited thereto. For example, where the substrate 10 is of circular shape, the fixed contact elements 15***o* to 15*z* may be radially arranged with respect to the ring 15*b*.

For the sake of description of the present invention, the fixed contact elements 15*o* to 15*z* is manufactured and shown in FIG. 4(b), which are connected to each other by the strip 15*a* and ring 15*b* as described above, will be generally referred to as a fixed contact carrier 15.

Two pairs of bearing lugs 16*a* and 16*b* are formed on the respective surface of the substrate 10; the bearing lugs 16*a* of one pair being also integral with the annular flange 12*a* and diametrically spaced from each other with respect to the annular flange 12*a* while the bearing lugs 16*b* of the other pair are also integral with the annular flange 12*b* and diametrically spaced from each other with respect to the annular flange 12*b*.

The fixed contact carrier 15 is embedded in the substrate 10 as hereinbefore described. This can readily be achieved in any known method, for example, plastic molding technique. At this time, the annular flanges 12*a* and 12*b*, hole 11, perforations 13 and 14 and bearing lugs 16*a* and 16*b* are also integrally formed on the substrate 10.

More specifically, during the manufacture of the substrate 10 by means of the plastic molding technique, the fixed contact carrier 15 must be held in position within a mold assembly such that said fixed contact carrier 15 can ultimately be positioned substantially intermediate the thickness of the substrate 10 with the portions of the fixed contact elements 15*o* to 15*z* adjacent the respective inner ends thereof aligned with each of the inner and outer rows of the perforations 13 and 14.

It will readily be seen that, at the time of completion of the manufacture of the substrate 10 with the fixed contact elements 15*o* to 15*z* embedded therein, each of the perforations 13 and 14 of the inner and outer rows is substantially divided into two sockets 13*a* and 13*b* or 14*a* and 14*b* by a corresponding one of the fixed contact elements 15*o* to 15*z* extending intermediately of the thickness of the substrate 10.

After the substrate 10 with the fixed contact carrier 15 embedded therein has been manufactured in the manner as hereinbefore described, the strip 15*a* and the ring 15*b* are removed by cutting to allow the contact elements 15*o* to 15*z* to be electrically separated from each other as shown by the broken lines in FIG. 3.

Alternatively, instead of the manufacture of the substrate with the carrier 15 therein by means of the plastic molding technique such as described above, the substrate 10 may be manufactured by laminating upper and lower layers with the carrier 15 sandwiched therebetween. The upper and lower layers are of the same construction and corresponding in shape and construction to the respective upper and lower halves of the illustrated substrate 10 substantially divided along the plane of the contact carrier 15. In this construction, it is necessary to manufacture each of the upper and lower layers prior to the carrier 15 being sandwiched therebetween. In any event, the employment of the plastic molding technique is advantageous in that the manufacture of the substrate 10 and the installation of the contact carrier 15 in the finished substrate 10 can be simultaneously achieved.

Housed within the annular flanges 12*a* and 12*b* and mounted on the opposed surfaces of the substrate 10 are rotary discs 17and 18 carrying movable contact elements 19 and 20, respectively in a manner as will now be described in details.

As best shown in FIG. 4(a), the rotary discs 17 and 18 have respective bearing holes 17*a* and 18*a* of such a size as will be described later, the outer diameter of each of said rotary discs 17 and 18 being equal to or slightly smaller than the inner diameter of the associated annular flange 12*a* or 12*b*.

In the embodiment of FIGS. 1 to 5 and 17, the movable contact elements 19 and 20 are of the same construction and are each composed of a circular conductive portion 19*a* or 20*a* and a conductive tongue 19*b* or 20*b* radially outwardly extending from said circular conductive portion 19*a* or 20*a*. Each of the movable contact elements 19 and 20 is secured to one surface of the corresponding rotary disc 17 or 18 by means of, for example, circuit a printing technique or by vacuum plating or vacuum evaporation coating of metal. Alternatively, the movable contact element 19 or 20 may be secured thereto by the use of any suitable bonding agent.

These rotary discs 17 and 18 are held in position within the associated annular flanges 12*a* and 12*b* in the substrate 10 by means of a mounting sleeve 21 of a construction as will now be described with particular reference to FIGS. 2, 3 and 4(a). As best shown in FIG. 4(a), the mounting sleeve 21 has one end integrally formed with a radially outwardly extending back-up base 21*a* and the other end integrally formed with a radially outwardly extending annular flange. The annular flange is divided into two flange portions 21*b* and 21*c* by means of a crevice 21*d* formed in said mounting sleeve 21 and extending from said other end thereof towards a portion adjacent said one end of said sleeve 21. The mounting sleeve 21 has such a cross-sectional shape that, when said sleeve 21 is inserted through the bearing holes 17*a* and 18*a* in the rotary discs 17 and 18 in a manner as will be described later, all of the elements 17, 18 and 21 can rotate together.

When the rotary discs 17 and 18 are to be held in position within the associated annular flanges 12*a* and 12*b* in the substrate 10, the first procedure is to insert the mounting sleeve 21 through either one of the holes 17*a* and 18*a* while the flange portions 21*b* and 21*c* are radially inwardly biased by the application of an external biasing force to allow that portions 21*b* and 21*c* to pass through the hole 17*a* or 18*a*. Thereafter, the mounting sleeve 21 while the flange portions 21*b* and 21*c* are still radially inwardly biased is allowed to pass through the hole 11 in the substrate and then through the other hole 17*a* or 18*a*. It will readily be seen that, when the external biasing force is removed, the flange portions 21*b* and 21*c* return to the original positions, respectively, by the effect of their own elasticity as shown in FIG. 2, thereby substantially clamping either one of the rotary discs 17 and 18, the substrate 10 and the other of the rotary discs 17 and 18 between the back-up base 21*a* and the flange portions 21*b* and 21*c* in the order given above.

It is to be noted that, prior to the mounting of the rotary discs 17 and 18 in position with respect to the substrate 10, intermediate contact pieces, generally indicated by 22, must be placed in position within some of either the sockets 13*a* and 14*a* or the sockets 13*b* and 14*b*. In the illustrated embodiment, as best shown in FIG. 3, twelve intermediate contact pieces 22 are employed and are placed in position only within some of the sockets 13*a* and 13*b* and, in particular, one of the intermediate contact pieces 22 is accommodated within one of the sockets 13*a* of the inner row while the other intermediate contact pieces 22 are respectively accommodated within the sockets 14*a* of the outer row except for one of said sockets 14*a* of the outer row which is radially adjacent the occupied socket 13*a* of the inner row.

In practice, the number of the intermediate contact pieces 22 to be employed and the positioning of the intermediate contact pieces in the sockets depend upon the shape of one or both of the movable contact elements 19 and 20. The shape of the contact elements is in turn determined by the switching characteristic desired to be exhibited by the ultimate electric switch assembly according to the present invention.

However, assuming that the twelve intermediate contact pieces 22 are placed within the socket 13*a* of the inner row and also within the sockets 14*a* of the outer row in the manner as best shown in FIG. 3 and that at least one of the movable contact elements 19 and 20 on the respective rotary discs 17 and 18, which is operatively associated with the twelve intermediate contact pieces 22, that is, the movable contact element 19, is shaped as shown in FIG. 4(a), it will readily be seen that the switching characteristic of the ultimate switch assembly is such that the fixed contact element 15*q* can selectively be engaged to any one of the remaining fixed contact elements 15*o*, 15*p*, 15*r*, 15*s*, 15*t*, 15*u*, 15*v*, 15*w*, 15*x*, 15*y* and 15*z*. This is accomplished through the movable contact element 19 depending upon the position of the conductive tongue 19*b* relative to the remaining fixed contact elements 15*o*, 15*p* and 15*r* to 15*z*.

While the switch unit SU is constructed in the manner as hereinabove described, the switch unit SU is coupled to the detent mechanism DM for accurately positioning at least the conductive tongue 19*b* of the movable contact element 19, so far as the illustrated embodiment is concerned, to align with any one of the remaining fixed contact elements 15*o*, 15*p* and 15*r* to 15*z*.

Figure 5:
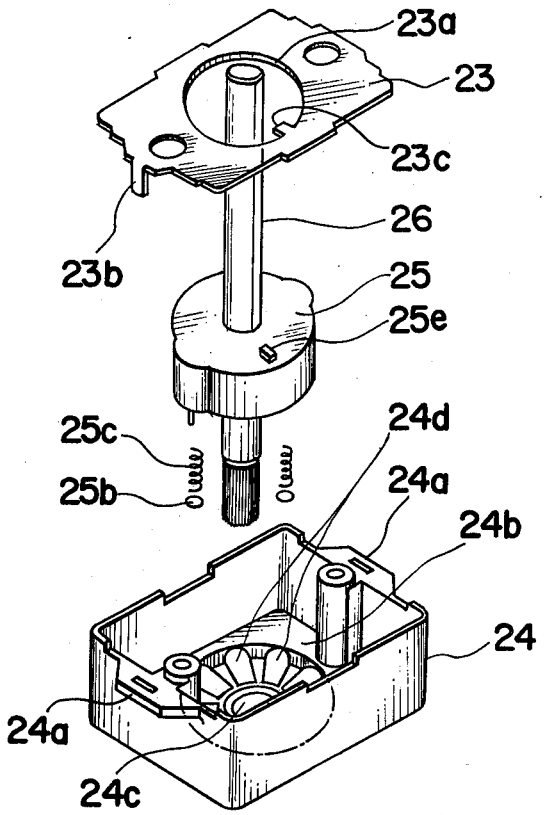
FIG. 5 is an exploded view of a detent mechanism employed in the switch assembly embodying the present invention, it being understood that the detent mechanism shown in FIG. 5 is substantially inverted upside down.

As best shown in FIGS. 1 and 5, the detent mechanism DM comprises a base plate 23 having a through-hole 23*a* formed therein, and a casing 24 rigidly mounted on said base plate 23 in any known method. In the illustrated embodiment, at least one pair of projections 23*b* formed in the base plate 23 in opposed relation to each other are inserted through perforated lugs 24*a* of the casing 24 and crimped to secure either one of the base plate 23 and the casing 24 to the other of the base plate 23 and the casing 24. Alternatively, any suitable method other than the crimping method can be employed, for example, by the use of fastening screws.

The casing 24 is substantially box-like in shape and has a top wall 24*b* formed with a bearing hole 24*c* at a substantially central portion thereof. As best shown in FIG. 5, the detent mechanism DM is shown as inverted in position with the various comonents thereof exploded. Detent recesses, generally indicated by 24*d* and equal in number to the number of the perforations 13 or 14 in the substrate 11, are formed on the inner surface of the top wall 24*b* of the casing 24 and arranged around the bearing hole 24*c* in coaxial relation thereto and circumferentially equally spaced from each other.

The detent mechanism DM further comprises a rotary block 25 rigidly mounted on, or otherwise integrally formed with a shaft 26 for rotation together with said shaft 26. The construction of the shaft 26 will be described later. The rotary block 25 is formed with a pair of recesses 25*a*, both extending from one end in parallel relation to the longitudinal axis of the shaft 26, and rotatably housed within the casing 24. As shown in FIG. 2 housed within the recesses 25*a* are detent balls 25*b*, which are outwardly biased by spring elements 25*c* operatively housed within the associated recesses 25*a* and positioned between the bottoms of the respective recesses 25*a* and the detent balls 25*b*. The detent balls 25*b* so positioned within the recesses 25*a* can selectively be engageable in the detent recesses 24*d* on the inner surface of the top wall 24*b* of the casing 24 so that click positions corresponding to the positions of the perforations 13 or 14 in the substrate 10 can be imparted to the rotation of the rotary block 25.

The shaft 26 has one end extending outwardly through the bearing hole 24*c* in the casing 24 and adapted to receive a knob (not shown). The other end is inserted through the mounting sleeve 21 so that rotation of the shaft 26 can be transmitted to the rotary discs 17 and 18 through the mounting sleeve 21. To accomplish the rotation of the sleeve 21, the other end of the shaft 26 is shaped to have a cross-sectional shape complementary to the substantially rectangular shape of the hollow portion of the mounting sleeve 21.

If it is not desirable that the rotary block 25 be rotatable through more than 360°, a rotation regulator may be provided. In the illustrated embodiment, as best shown in FIG. 5, the rotation regulator comprises a projection 23*c*, formed in the base plate 23 and radially inwardly extending into the through-hole 23*a*, and an engagement 25*e* integrally formed in the rotary block 25 and outwardly extending in a direction parallel to the longitudinal axis of the shaft 26. The engagement 25*e* is cooperative with said projection 23*c* so that the rotary block 25 and, therefore, the shaft 26 can be manually rotatable only through a substantial angle of 360° about the longitudinal axis of the shaft 26.

Figure 2:
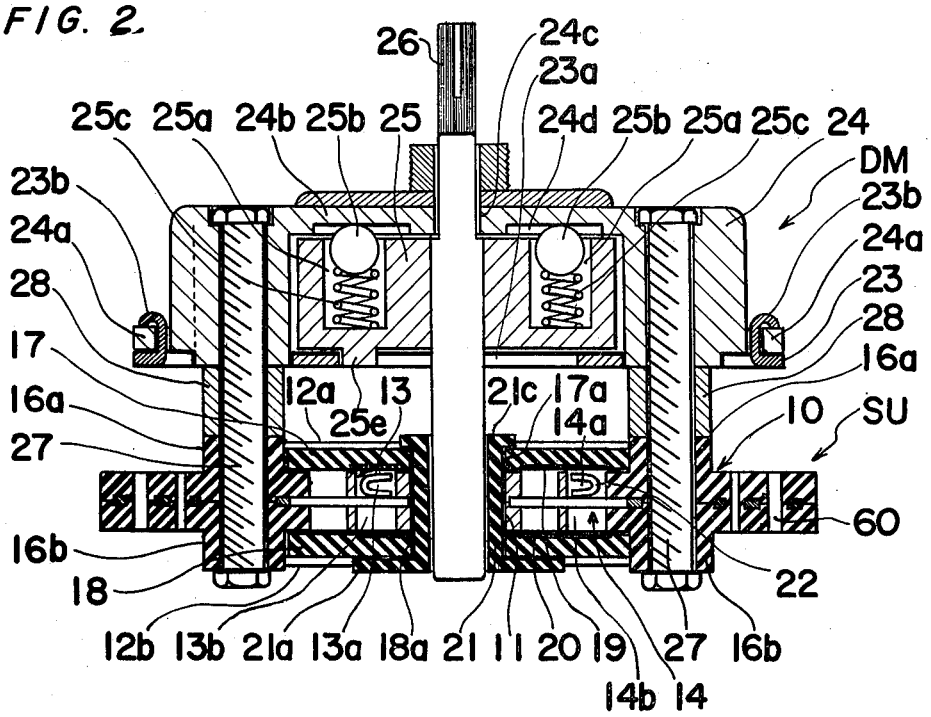
FIG. 2 is a front sectional view, on an enlarged scale, of the switch assembly of FIG. 1, substantially taken along the line II—II in FIG. 3.

As best shown in FIG. 2, the switch assembly SU is connected to the detent mechanism DM by means of a pair of bolts and nuts, generally indicated by 27, with spacer sleeves 28 mounted thereon between the detent mechanism DM and the switch assembly SU as shown.

From the foregoing description, it is clear that, by rotating the shaft 26 to any one of the click positions defined by the detent balls 25*b* and the detent recesses 24*b* cooperative therewith, the fixed contact element 15*q* can be electrically connected to any one of the remaining fixed contact elements 15*o*, 15*p* and 15*r* to 15*z* through the movable contact element 19. At this time, while the circular conductive portion 19*a* of the movable contact element 19 is constantly engaged to the fixed contact element 15*q* through the intermediate contact piece 22, the conductive tongue 19*b* of the same movable contact element 19 is selectively engaged to any one of the remaining fixed contact elements through the intermediate contact pieces depending upon the position of the shaft 26 and, therefore, the rotary disc 17.

In the foregoing embodiment, the intermediate contact pieces 22 have been described as placed within one of the sockets 13*a* of the inner row and also within the sockets 14*a* of the outer row except for one of said sockets 14*a* which is radially adjacent the occupied socket 13*a*. However, they may be placed within one of the sockets 13*b* of the inner row and also within the sockets 14*b* of the outer row except for one of said sockets 14*b* which is radially adjacent the occupied socket 13*b*, in a manner substantially similar to that shown in FIG. 3. In this arrangement, selective engagement of one of the fixed contact elements, which is aligned with the occupied socket 13*b*, to any one of the remaining fixed contact elements which are aligned with said sockets 14*b* except for one of said sockets 14*b* which is radially adjacent the occupied socket 13*b* can be achieved by means of the movable conductive element 20.

Furthermore, it is clear that, depending upon the switching characteristic desired to be achieved by the ultimate switch assembly according to the present invention, some of the intermediate contact pieces 22 housed within the sockets 14*a* or 14*b* of the outer row may be removed and this removal can readily be carried out by substantially dismantling the switch assembly SU in such a way as to separate one or both of the rotary discs 17 and 18 from the substrate 10.

In the foregoing embodiment, the fixed contact elements 15*o* to 15*z* have been described as embedded in the substrate 10 and situated substantially intermediate of the thickness of said substrate 10. Moreover, the fixed contact elements 15*o* to 15*z* in the foregoing embodiment have been described as manufactured from a single plate of electrically conductive material. However, the fixed contact elements may be constituted by printed circuits which will now be described with reference to FIGS. 6 to 8 and 18.

Referring now to FIGS. 6 to 8 and 18, the embodiment shown in FIGS. 6 to 8 and 18 substantially differs from that of FIGS. 1 to 5 and 17 in that, the fixed contact carrier 15 in the embodiment of FIGS. 1 to 5 and 17, is ultimately formed into the fixed contact elements prior to said carrier 15 being embedded in the substrate 10, while the fixed contact elements in the embodiment of FIGS. 6 to 8 and 18 are constituted by a plurality of radially outwardly extending printed circuits, generally indicated by 30, which are imprinted on a support 31 of, for example, circular shape made of an electrically insulating material, by the use of any known circuit printing technique. In the illustrated embodiment of FIGS. 6 to 8 and 18, the fixed contact elements 30 are shown as formed on each of the opposed surfaces of the support 31 and this is in fact required if a substrate of substantially the same construction as shown in FIGS. 1 to 5 and 17 is employed. However, if a lower portion of the substrate 10 in which the sockets 13*b* and 14*b* of the inner and outer rows is deemed not necessary, the corresponding structure is achieved by omitting the fixed contact elements from one of the opposed surfaces of the support 31.

Figure 7:
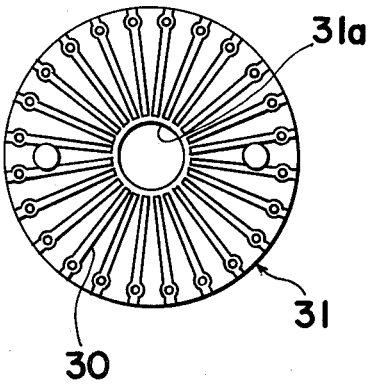
FIG. 7 is a top plan view of a substrate having a plurality of fixed contact elements printed thereon, which substrate is employed in the switch assembly of FIG. 6.
Figure 6:
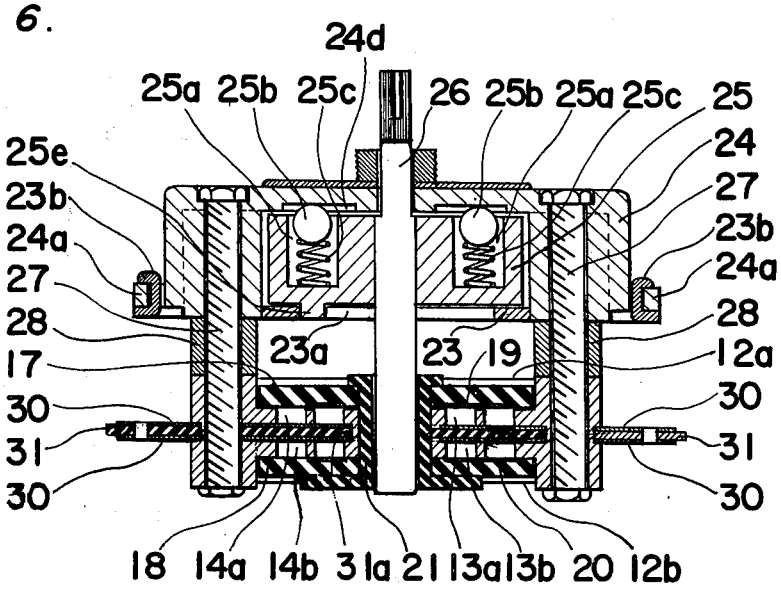
FIG. 6 is a view similar to FIG. 2, showing a switch assembly according to another preferred embodiment of the present invention.

The fixed contact carrier of the construction as best shown in FIG. 7 is sandwiched between upper and lower portions, both of said upper and lower portions forming the substrate 10. In practice, there is no boundary between the upper and lower portions of the substrate 10 because these upper and lower portions are integral with each other by the reason which will now be described. However, it is to be noted that, in the embodiment of FIGS. 6 to 8 and 18, an outer peripheral portion of the fixed contact carrier, constituted by the support 31 bearing the fixed contact elements 30 printed thereon, is bared to the outside from the substrate 10 thus enabling some or all of the outer ends of the respective printed contact elements 30 to be readily connected with external electric wirings.

The upper and lower portions of the substrate 10, wherein the upper portion has the sockets 13*a* and 14*a* of the inner and outer rows formed therein and the lower portion has the sockets 13*b* and 14*b* of the inner and outer rows formed therein in alignment with the sockets 13*a* and 14*a* in the upper portion as substantially described in connection with the foregoing embodiment of FIGS. 1 to 5 and 17, are integrally connected to each other through perforations 31*a* formed in the support 31 in the embodiment of FIGS. 6 to 8 and 18. This is possible by selecting the diameter of each of the perforations 31*a* to be greater than the diameter of any of the bolts 27 used to connect the switch unit SU with the detent mechanism DM. In addition, the upper and lower portions of the substrate 10 are, as is the case in the embodiment of FIGS. 1 to 5 and 17, also connected to each other through a central opening 31*a* formed in the support 31 and being of a diameter greater than the diameter of the mounting sleeve 21.

The substrate 10 in the embodiment of FIGS. 6 to 8 and 18 is also formed by plastic molding in a substantially similar manner as the substrate 10 in the embodiment of FIGS. 1 to 5 and 17.

Even the switch assembly according to the embodiment of FIGS. 6 to 8 and 18 functions satisfactorily and effectively in a substantially identical manner as that according to the embodiment of FIGS. 1 to 5 and 17.

Figure 9:
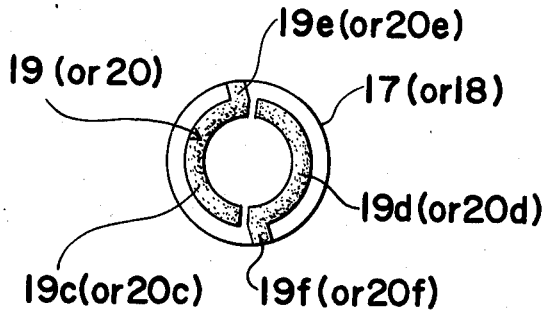
FIGS. 9 and 10 are plan views of a rotary disc showing different arrangements of the movable contact element useable in any of the switch assemblies of FIGS. 2 and 6.
Figure 10:
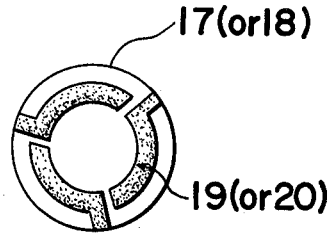
Figure 8:
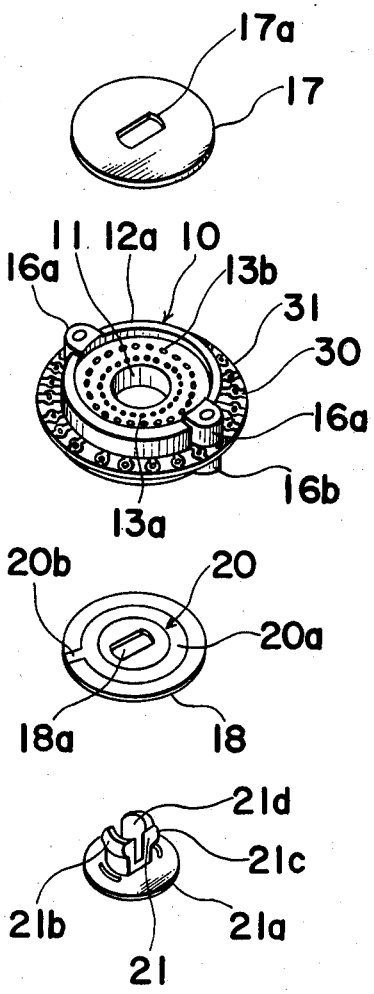
FIG. 8 is an exploded view of a switch unit employed in the switch assembly of FIG. 6.

FIGS. 9 and 10 illustrate possible variations in the arrangement of the movable contact elements carried by the rotary discs 17 and 18. In FIG. 9, the movable contact element 19 or 20 on the rotary disc 17 or 18 includes a pair of 180° spaced conductive portions 19*c* and 19*d* or 20*c* and 20*d* and a pair of 180° spaced conductive tongues 19*e* and 19*f* or 20*e* and 20*f*, respectively, integrally extending from the conductive portions 19*c* and 19*d* or 20*c* and 20*d*. When employing the movable contact element 19 or 20 of the construction as shown in FIG. 9, it is recommended that the number of intermediate contact pieces 22 positioned within the sockets 13*a* or 13*b* aligned with the path of movement of the conductive portions 19*c* and 19*d* or 20*c* and 20*d* be two and that the rotation regulator, such as composed of the projection 23*c* and the engagement 25*e* in the foregoing embodiment, also employ two.

Similarly, the movable contact element 19 or 20 may be shaped such as shown in FIG. 10.

In any of the foregoing embodiments of FIGS. 1 to 5 and 17 and FIGS. 6 to 8 and 18, the present invention has been described as applied to a rotary switch assembly. However, the concept of the present invention can equally be applicable to a switch assembly of a slide type which will now be described with particular reference to FIGS. 11 to 13 and 19.

Figure 11:
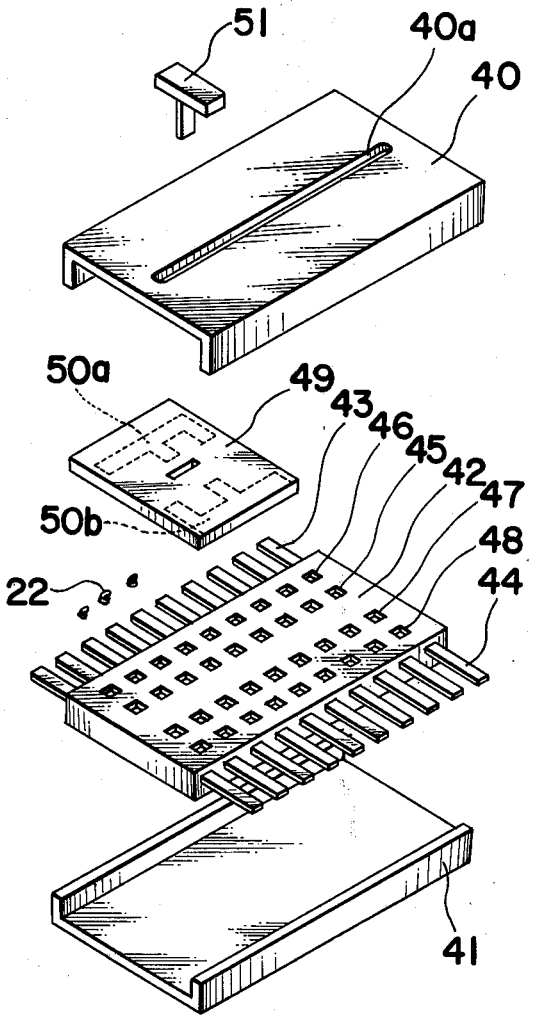
FIG. 11 is an exploded view of a switch assembly according to a further embodiment of the present invention.
Figure 12:
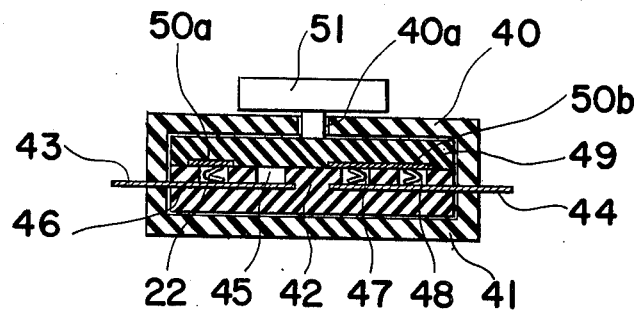
FIG. 12 is a cross-sectional view of the switch assembly of FIG. 11.
Figure 19:
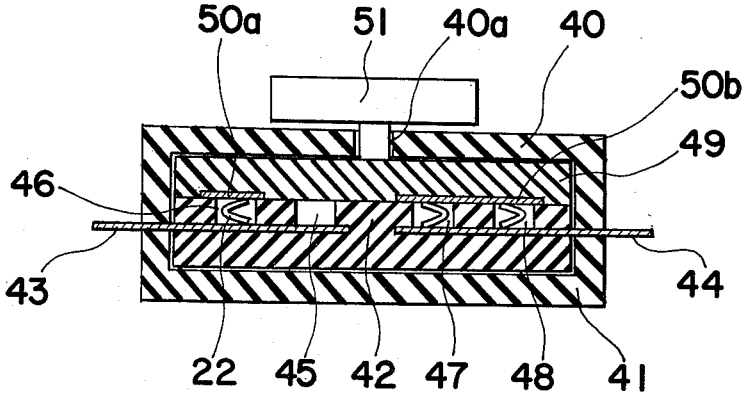
FIG. 19 is an enlarged view of the switch assembly of FIG. 12.

Referring first to FIGS. 11, 12 and 19, the switch assembly according to a further embodiment of the present invention comprises first and second casings 40 and 41 of substantially U-shaped cross-section, one of said casings 40 being formed with a guide slot 40*a* extending in a direction lengthwise of said casing and substantially intermediately of the width of said casing.

Housed within a space defined by the casings 40 and 41 when the latter are secured to each other is a substrate 42 of electrically insulating material. The substrate 42 has two groups of fixed contact elements 43 and 44 embedded therein in such a manner that the fixed contact elements 43 of one group extend in parallel relation to each other into the substrate 42 and terminating substantially adjacent the imaginary plane perpendicular to the plane of any of the opposed surfaces of said substrate and passing intermediately of the width of the substrate 42. The fixed contact elements 44 of the other group extend in parallel relation to each other into the substrate 42 from the opposed side of said substrate 42 in alignment with the associated fixed contact elements 43 of said one group and terminating substantially adjacent said imaginary plane.

These fixed contact elements 43 and 44 can readily be embedded in predetermined arrangement in the substrate 42 by a plastic molding method similar to that employed in making the fixed contact elements of the embodiment of FIGS. 1 to 5 and 17.

During the manufacture of the substrate 42 with the fixed contact elements 43 and 44 embedded therein in the predetermined arrangement, two pairs of inner and outer rows of sockets are formed. The sockets of the inner and outer rows of one pair being designated by 45 and 46, respectively, and the sockets of the inner and outer rows of the other pair being designated by 47 and 48, respectively. Each of the sockets 45 to 48 extends from one of the opposed surfaces of the substrate 42, which faces the casing 40, and terminated in alignment with any corresponding one of the fixed contact elements 43 and 44. Also, the individual rows of the sockets 45 to 48 substantially extend in parallel relation to each other and also in parallel relation to the lengthwise direction of the substrate 42.

Mounted on the substrate 42 and slidably accommodated within a space defined between said substrate and the casing 40 is a slidable plate 49 made of electrically insulating material. This slidable plate 49 has one surface facing the substrate 42 and formed with a pair of spaced movable contact elements 50*a* and 50*b* secured thereto in a manner similar to the movable contact elements 20 and 21 in the foregoing embodiment of FIGS. 1 to 5 and 17. Prior to positioning the slidable plate 49 within the space between the substrate 42 and the casing 40, intermediate contact pieces 22 are placed within some of the sockets 45 to 48 of the individual rows depending upon the switching characteristic desired to be achived by the switch assembly of FIGS. 11, 12 and 19. This will be described in more details in connection with the operation of the switch assembly of FIGS. 11, 12 and 19.

For moving the slidable plate 49, a slider knob 51 accessible to the hand of an operator of the switch assembly is rigidly connected to said slidable plate 49 through the guide slot 40*a* formed in the casing 40.

Figure 13A:
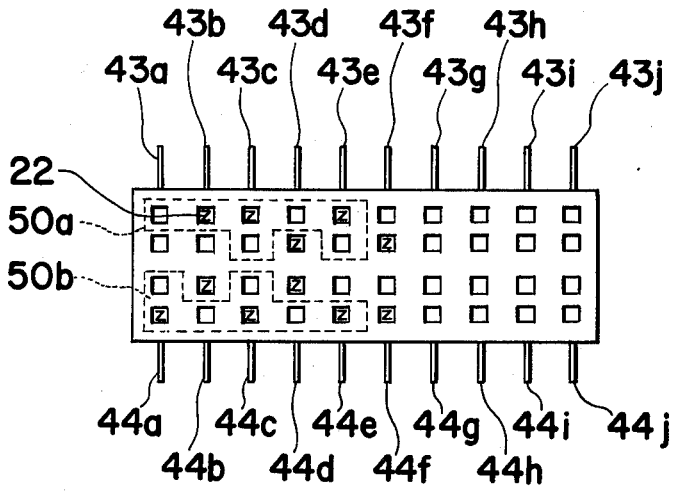
FIGS. 13(a) and (b) illustrate different positions of a movable contact carriage, which is employed to show the operation of the switch assembly of FIG. 11.
Figure 13B:
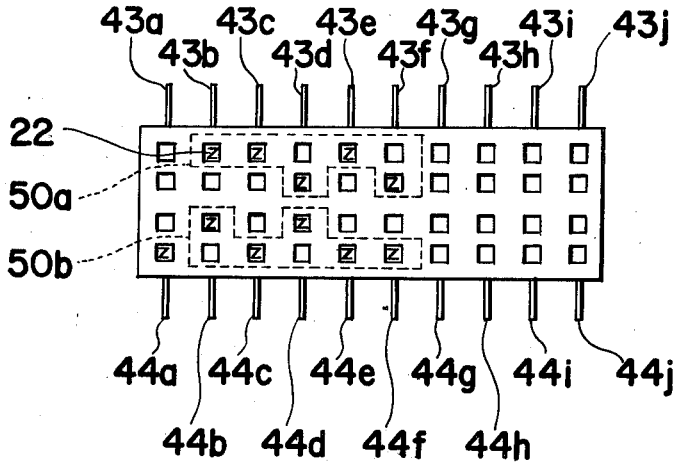

Referring now to FIGS. 13(a) and (b), assuming that the intermediate contact pieces 22 are placed within the sockets 45 aligned with the fixed contact elements 43*d* and 43*f*, respectively the sockets 46 aligned with the fixed contact elements 43*b*, 43*c* and 43*e*, respectively the sockets 47 aligned with the fixed contact elements 44*b* and 44*d*, respectively and the sockets 48 aligned with the fixed contact element 44*a*, 44*c*, 44*e* and 44*f*, respectively. Also, assuming that the slidable plate 49 is positioned such as shown in FIG. 13(a), it is clear that the fixed contact elements 43*b*, 43*c* and 34*e* are electrically connected to each other through the movable contact element 50*a* while the fixed contact elements 44*a*, 44*c* and 44*e* are electrically connected to each other through the movable contact element 50*b*. On the other hand, if the slidable plate 49 is subsequently moved towards the right a distance corresponding to the pitch between two adjacent sockets of each row to assume such a position as shown in FIG. 13(b), the fixed contact elements 43*b*, 43*c*, 43*d*, 43*e* and 43*f* are electrically connected to each other through the movable contact element 50*a* while the fixed contact elements 44*b*, 44*c*, 44*d*, 44*e* and 44*f* are electrically connected to each other through the movable contact element 50*b*.

It is to be noted that, depending upon the design desired of the switch assembly, either the sockets 45 and 46 together with the fixed contact elements 43 and the movable contact element 50*a* or the sockets 47 and 48 together with the fixed contact elements 44 and the movable contact element 50*b* may be omitted. Moreover, depending upon the shape of the movable contact element 50*a* or 50*b* or the movable contact elements 50*a* and 50*b*, one of the inner and outer rows of the sockets 45 to 48 may be omitted.

Hereinafter, the details of each of the intermediate contact pieces 22 which can be employed in any of the foregoing embodiments of FIGS. 1 to 5 and 17, FIGS. 6 to 8 and 18 and FIGS. 11 to 13 and 19 will be described.

Referring to FIG. 4(a), the illustrated intermediate contact piece 22 is made of a strip of metallic material having a sufficient elasticity. The strip of metallic material is bent at a substantially intermediate portion thereof to represent a substantially V-shaped cross-section. More specifically, in order to ensure the accurate engagement between each end of the intermediate contact piece 22 and any of the fixed contact element and movable contact element, the intermediate contact piece 22 is made from a metallic strip of substantially H-shape bent at a substantially bridging portion of a figure "H" so that each end of the intermediate contact piece 22 has two contact points engageable to any of the fixed and movable contact element.

Figure 14:
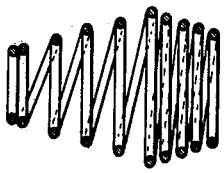
FIG. 14 is a longitudinal sectional view of a spring element constituting any one of intermediate contact pieces usable in any of the switch assemblies of FIGS. 1 to 5, FIGS. 6 to 8 and FIGS. 11 to 13.
Figure 15:
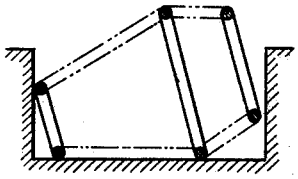
FIGS. 15(a) and (b) illustrate different shapes of the spring element of FIG. 14, showing how the movable contact element is electrically connected to any one of the fixed contact element.
Figure 15:
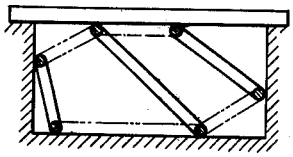

In the example shown in FIGS. 14 and 15, the intermediate contact piece 22 is constituted by a coiled spring. This coiled spring is designed such that a substantially intermediate portion thereof has a greater outer diameter than that of any of the opposed ends thereof while convolutions of a left-hand portion of the coiled spring between said substantially intermediate portion and one of the opposed ends thereof are spaced a distance greater than the distance between the adjacent convolutions of a right-hand portion of the same coiled spring between said substantially intermediate portion thereof and the other of said opposed ends.

When the coiled spring shown in FIG. 14 is to be placed within the socket, as best shown in FIG. 15(a) the left-hand portion of the coiled spring is preferably held flat against the fixed contact element while the right-hand portion of the same coiled spring is adapted to engage the movable contact element. FIG. 15(b) shows how the coiled spring is deformed elastically within the socket and it is clear that many contact points are available between the convolutions of the left-hand portion of the coiled spring and the fixed contact element and also between the convolutions of the right-hand portion of the same coiled spring and the movable contact element.

Figure 16:
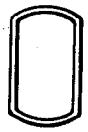
FIGS. 16(a) and (b) are longitudinal elevational and side views, respectively, of another spring element constituting the intermediate contact piece.
Figure 16:
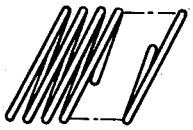
Figure 17:
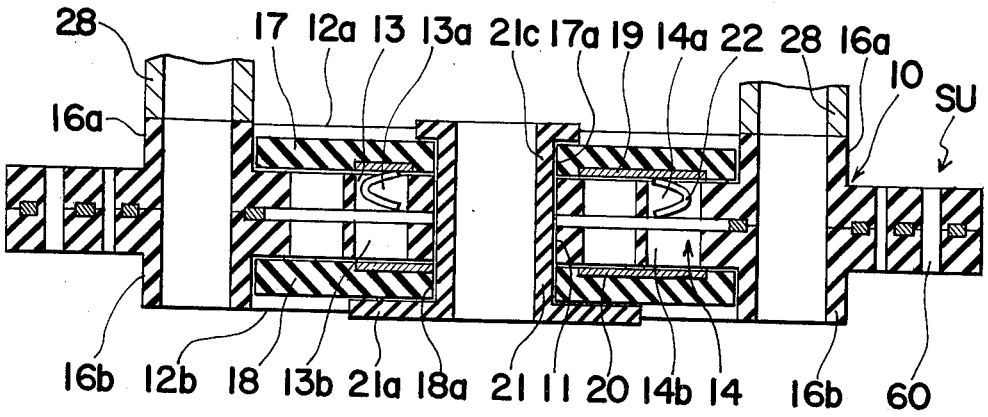
FIG. 17 is an enlarged view of the lower portion of FIG. 2 showing the switch unit.
Figure 18:
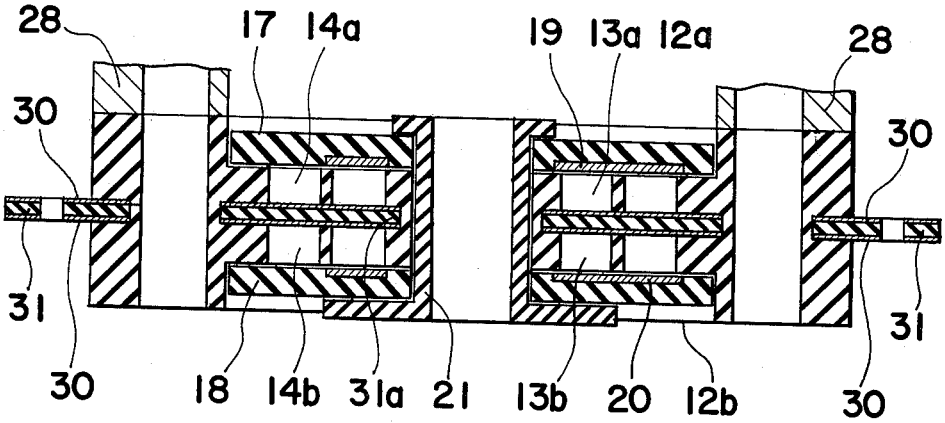
FIG. 18 is an enlarged view of the lower portion of the switch assembly of FIG. 6.

A coiled spring shown in FIGS. 16(a) and (b) may also be employed as the intermediate contact piece 22. The coiled spring shown in FIGS. 16(a) and (b) is designed such that the opposed portions of each of the convolutions of the coiled spring are substantially straightened while non-straightened portions, which are 180° spaced from each other about the longitudinal axis of the coiled spring, of each of the convolutions of the coiled spring are substantially permanently set in the form as biased in the opposite directions parallel to the longitudinal axis of the coiled spring, as best shown in FIG. 16(b).

It is to be noted that the outer span between the opposed straightened portions of each of the convolutions of the coiled spring is substantially equal to or slightly smaller than the width of the socket in which it is to be accommodated.

When the coiled spring of the construction shown in FIGS. 16(a) and (b) is to be placed in position within the socket, the coiled spring is placed therein with the longitudinal axis thereof extending approximately perpendicular to the direction of movement of the movable contact element in the switch assembly.

Although the present invention has fully been described in connection with the preferred embodiments thereof with reference to the accompanying drawings, it is to be noted that various changes and modifications are apparent to those skilled in the art. By way of example, since the detent mechanism DM herein discloses does not constitute the subject matter of the present invention, any known detent mechanism may be employed. Moreover, the arrangement of the sockets in the substrate and/or the shape of the movable contact element may not be limited to that shown. For example, where there are three electric wirings and one of these electric wirings is desired to be selectively connected to any of the other two wirings, the movable contact element carried by the rotary disc may be in the form of an elongated strip of electrically conductive material, having one end constantly engaged to one of the fixed contact elements which is in turn connected to said one of said electric wirings, through an intermediate contact piece, while the sockets, three in number, may be formed in the substrate in a substantially triangular arrangement with the intermediate contact pieces therein.

Furthermore, particularly where the switch assembly according to the present invention is incorporated in an audio and/visual instrument, there can be considered a possibility of occurrence of crosstalk, that is, interference between signals on different channels because even the synthetic resin used as a material for the substrate referred to above has an dielectric constant higher than air. In order to substantially eliminate this, as shown in FIGS. 2 and 3, a plurality of slots are preferably formed in the substrate each extending between each adjacent two of the fixed contact elements thereby minimizing the stray capacitance which may otherwise be charged on the substrate. So far as the embodiment of FIGS. 1 to 5 and 17 is concerned, these slots formed for minimizing the stray capacitance are generally indicated by 60.

In addition, although in any of the foregoing embodiments of FIGS. 1 to 5 and 17 and FIGS. 6 to 8 and 18 the switch assembly has been described as having a single switch unit SU, it is to be noted that the switch assembly may have two or more switch units SU. In such case, the switch units are stacked one above the other in spaced relation to each other.

Accordingly, these changes and modifications are to be understood as included within the true scope of the present invention unless they depart therefrom.

What is claimed is:

1. An electrical switch assembly which comprises in combination:

a substantially plate-like substrate made of electrically insulating material and having first and second surfaces opposed to each other;

a plurality of elongated, fixed contact elements made of electrically conductive material and embedded in said substrate in spaced relation to each other with a plane of each of said fixed contact elements lying substantially intermediately of the thickness of said substrate, each of said fixed contact elements having an outer end extending outwardly from a periphery of said substrate for external electrical connection;

at least one first socket defined in said substrate and opening on either one of said first and second substrate surfaces, said first socket extending from the opening on said either one of the first and second substrate surfaces into the substrate substantially halfway the thickness of said substrate and terminating at and in alignment with one of respective inner ends of said fixed contact elements thereby exposing said one of the inner ends of the fixed contact elements to the outside of said substrate through the opening on said either one of said first and second substrate surfaces;

a plurality of second sockets defined in said substrate in spaced relation to each other and also to said first socket and opening on said either one of the first and second substrate surfaces, said second sockets extending from the respective openings on said either one of the first and second substrate surfaces into the substrate substantially halfway the thickness of the substrate and terminating at and in alignment with associated portions ajacent the inner ends of the remaining fixed contact elements thereby exposing the portions adjacent the inner ends of the remaining fixed contact elements to the outside of the substrate through the respective openings on either one of the first and second substrate surfaces;

removable intermediate contact pieces made of electrically conductive material, one of said intermediate contact pieces being removably accommodated within the first socket and additional contact pieces being removably accommodated within substantially all of the second sockets;

at least one movable contact element movably supported on said either one of said first and second substrate surfaces;

means carrying said movable contact element for positioning said movable contact element to any one of a plurality of switching positions; and said movable contact element being so shaped that, depending upon the position of said movable contact element, said one of said respective inner ends of the fixed contact element is electrically connected to any one of said portions adjacent the inner ends of some or all of the fixed contact elements through said movable contact element by means of said contact piece within said first socket via the additional contact pieces within substantially all of the second sockets.

2. An electrical switch assembly as claimed in claim 1, wherein said substrate is formed with a plurality of slots extending in between pairs of said inner end portions of said fixed contact elements.

3. An electrical switch assembly as claimed in claim 1, wherein each of said intermediate contact pieces comprise a coiled spring.

4. An electrical switch assembly as claimed in claim 1, wherein each of said intermediate contact pieces comprise a substantially elongated strip bent at a substantially intermediate portion thereof to have a substantially V-shaped cross section, one end of the shape of a figure V being held in contact with the fixed contact element and the other end of the shape of the figure V in contact with the movable contact element.

5. An electrical switch assembly as claimed in claim 1, wherein a plurality of first sockets are defined in said substrate which are equal in number to the plurality of second sockets.

6. An electrical switch assembly as claimed in claim 1, wherein the plurality of second sockets are arranged in a circular configuration and the movable contact element includes a circular conductive element adapted to mate with the intermediate contact piece removably accommodated within the first socket and further includes at least one outwardly projecting conductive element adapted to selectively mate with at least one of the intermediate contact pieces removably accommodated within the second sockets.

7. An electrical switch assembly according to claim 1, wherein the means carrying the movable contact element is a rotatable shaft;

the first socket comprises a plurality of sockets in coaxially arrangement with the rotatable shaft; and the plurality of second sockets are radially displaced from the plurality of first sockets and in coaxially arrangement with the rotatable shaft.

8. An electrical switch assembly according to claim 7, wherein one of the intermediate contact pieces is positioned within one of the first plurality of sockets and the remaining contact pieces are positioned in the plurality of second sockets except for the socket which is radially adjacent the occupied one of the first sockets.

9. An electrical switch assembly according to claim 7, wherein the movable contact element includes a circular electrical conductive material adapted to mate with the intermediate contact piece removably accommodated within one of the plurality of first sockets and further includes at least one electrical conductive member outwardly projecting from the circular electrical conductive material adapted to selectively mate with at least one of the intermediate contact pieces removably accommodated within the plurality of second sockets.

* * * * *